US005490489A

United States Patent [19]

Mayer et al.

[11] Patent Number: 5,490,489

[45] Date of Patent: Feb. 13, 1996

[54] IGNITION SYSTEM FOR AN INTERNAL COMBUSTION ENGINE

[75] Inventors: Ulrich Mayer, Waiblingen; Peter Kaltenbrunn, Bietigheim-Bissingen; Wolfgang Hoeptner, Uhingen; Karsten Mischker, Leonberg, all of Germany

[73] Assignee: Robert Bosch GmbH, Stuttgart, Germany

[21] Appl. No.: 244,645

[22] PCT Filed: Nov. 12, 1992

[86] PCT No.: PCT/DE92/00938

§ 371 Date: Jun. 6, 1994

§ 102(e) Date: Jun. 6, 1994

[87] PCT Pub. No.: WO/9311356

PCT Pub. Date: Jun. 10, 1993

[30] Foreign Application Priority Data

Dec. 5, 1991 [DE] Germany ..... 41 40 147.6

[51] Int. Cl.[6] ..... F02P 11/00

[52] U.S. Cl. ..... 123/630

[58] Field of Search ..... 123/630, 481, 123/425, 479, 435, 480, 198 D, 198 DB; 73/119 A; 364/431.09, 431.11

[56] References Cited

U.S. PATENT DOCUMENTS 5,058,551 10/1991 Nakaniwa .
5,134,987 8/1992 Mayer et al. .

FOREIGN PATENT DOCUMENTS 0442687 8/1991 European Pat. Off. .
4016307 11/1991 Germany .
4120935 1/1992 Germany .

*Primary Examiner*—Raymond A. Nelli
*Attorney, Agent, or Firm*—Kenyon & Kenyon

[57] ABSTRACT

An ignition system for internal combustion engines includes a monitoring circuit (9) which is used for introducing appropriate emergency measures for protecting the catalyst in the case of faulty ignitions. The ignition system includes an evaluation device (10), which subjects the ignition-diagnostic signal (Zünd OK) to statistical weighting and, when the weighted ignition-diagnostic value (ZÜNTAB) exceeds a specified threshold, introduces appropriate measures, the evaluation being continued steadily so that if the value subsequently falls below the fault threshold (AFS-DZU), correction is recognized and the emergency measures are withdrawn.

18 Claims, 4 Drawing Sheets

IGNITION SYSTEM FOR AN INTERNAL COMBUSTION ENGINE

BACKGROUND OF THE INVENTION

Ignition circuit monitoring for ignition systems is already known in which a sensor signal is generated by an ignition current sensor when each ignition takes place, this sensor signal being stored in a memory and read out after each ignition. The memory content is reset, in turn, after each subsequent ignition, so that an ignition failure is recognized when there is no sensor signal. This ignition circuit monitoring, however, offers no possibility of detecting the frequency of misfirings or the loading of the ignition system due to misfirings. Thus, for example, a single misfiring which is then followed by a very large number of proper ignitions is negligible, but it is disadvantageous when the number of misfirings equals the number of proper ignitions.

SUMMARY OF THE INVENTION

In the ignition system according to the present invention an ignition-diagnostic signal is detected and selectively evaluated for each cylinder. After an ignition, the ignition-diagnostic signal is statistically weighted for each cylinder in an evaluation device, so that the threshold for introducing emergency measures to protect the catalyzer is only exceeded at a certain number of ignition failures in a specified time. A further advantage may be seen in the fact that the ignition in the cylinder does not have to be interrupted so that this cylinder is able to be corrected.

In accordance with an embodiment of the present invention, an amount which is larger than 1 is added to the previous diagnostic value, in the case of a faulty ignition, and the value 1 is subtracted in the case of a correct ignition in order to form the weighted ignition-diagnostic value. The value, which is to be added in the case of a faulty ignition, is determined in practice for each engine type. The threshold, from which emergency measures are introduced, is also determined in practice. Finally, it should also be mentioned as an advantage that the weighted ignition-diagnostic value (ZÜNTAB) is limited to an applicable maximum value (AFXDZU) on reaching the latter, and the number of correct ignitions until correction of a previously defective cylinder has been recognized is fixed by means of the interval between the fault threshold (AFSDZU) and the maximum value (AFXDZU).

DETAILED DESCRIPTION OF THE INVENTION

Figure 1:
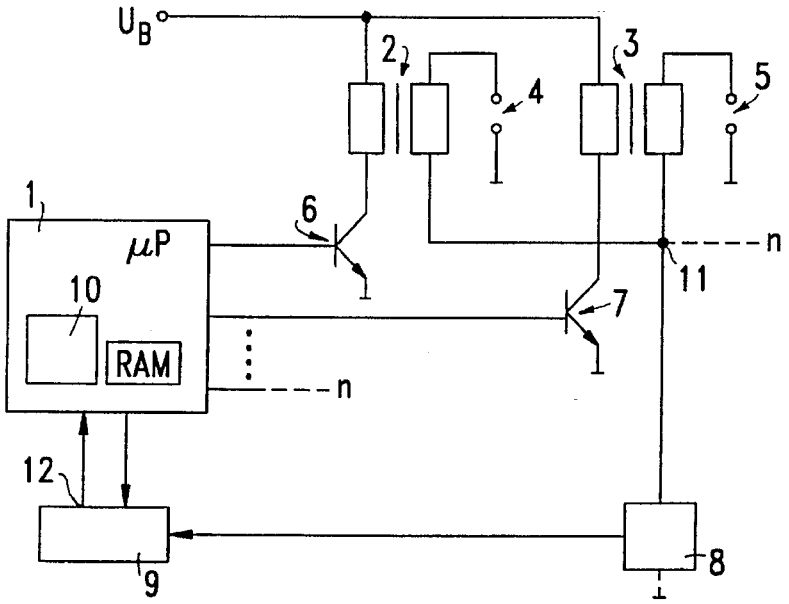
FIG. 1 shows the construction, in principle, of an ignition system for detecting the ignition-diagnostic signal.

FIG. 1 shows a distributorless ignition device, which consists of a microprocessor 1, ignition coils 2 and 3 (it also being quite possible to connect further ignition coils, as is indicated by interrupted lines) sparking plugs 4 and 5, ignition transistors 6 and 7, an ignition-current sensor 8, a monitoring circuit 9 and an evaluation device 10 arranged in the microprocessor.

The primary windings of the ignition coils 2 and 3 are connected to the battery voltage $U_B$, so that when the ignition transistors 6 and 7 are triggered by the microprocessor 1, a charging current flows in the corresponding primary winding of the ignition coil 2 or 3. The dwell periods of the ignition transistors are fixed by an ignition computer contained in the microprocessor 1. In order to initiate ignition, the ignition transistor is forced into the blocked condition, so that a high voltage is generated in the secondary windings of the ignition coils, and this high voltage produces an ignition spark at the spark plugs. An ignition current sensor 8 is arranged in the secondary circuit of each ignition coil between the output of the secondary winding and earth in such a way that all the secondary windings are previously connected together at a point 11. In this way, the ignition current sensor 8 detects the signals from all the ignition coils. In order to detect an ignition signal, it is also, for example, possible to detect the spark voltage transformed to the primary side. The ignition signal detected by the ignition current sensor 8 is relayed to a monitoring circuit 9. The output of the monitoring circuit is set to high level by the microprocessor 1 before each ignition. In the case of each properly occurring ignition, the output 12 of the monitoring circuit is switched from high to low on the basis of the ignition signal transmitted by the ignition current sensor 8. If no ignition is initiated or if the ignition does not proceed properly, the output 12 of the monitoring circuit 9 remains at high level. An ignition-diagnostic signal is therefore applied to the output 12 of the monitoring circuit 9 and is fed to the evaluation device 10 of the microprocessor 1. The evaluation circuit 10 can allocate the ignition-diagnostic signal to the corresponding cylinder in each case through a comparison with the firing sequence. A circuit in which the output 12 of the monitoring circuit 9 remains at high after a correct ignition and a faulty ignition causes switching to low is also conceivable. Finally, it is also possible to set the output 12 to low before each ignition and to switch to high or remain at low in the case of a correct ignition.

Figure 2:
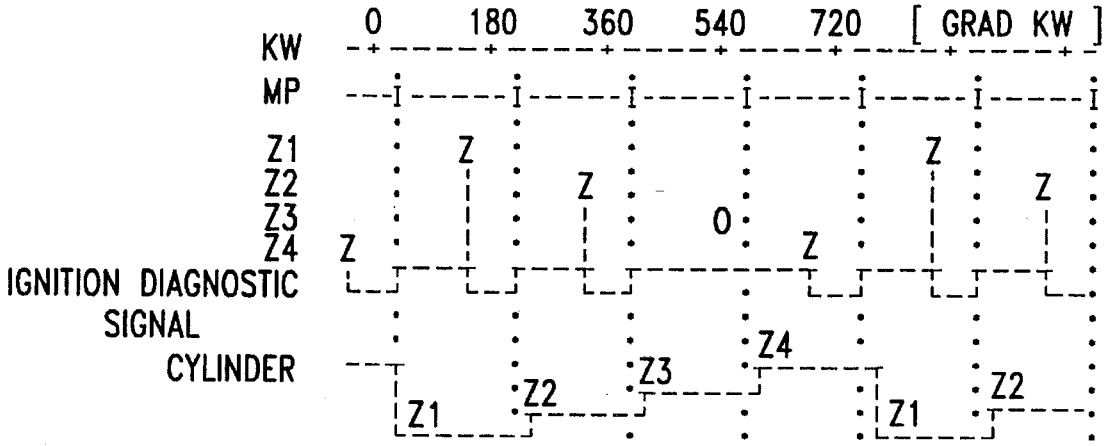
FIG. 2 shows an ignition-diagnostic signal.

FIG. 2 shows how the ignition-diagnostic signal (Zünd OK) is formed. The diagram shows the crankshaft angle (KW) of the internal combustion engine. The ignition-diagnostic signal (Zünd OK) is set to 1 (high) before each ignition (Z) by the microprocessor 1 so that this ignition-diagnostic signal has a predetermined level in each case at the time of the ignition (Z). If an ignition now occurs in cylinder 1 (Z1), the ignition diagnosis signal (Zünd OK) is set to zero by the signal from the ignition current sensor 8. If the ignition current sensor 8 has not transmitted an ignition signal, as in the present case for cylinder 3 (Z3), the ignition-diagnostic signal remains at the predetermined level (high). The typical digital ignition-diagnostic signal sequence (Zünd OK) therefore occurs. The ignition-diagnostic signal can be associated with one cylinder at each measurement point (MP) by means of the signal sequence. The incorrectly operating cylinder can therefore be diagnosed.

Figure 3A:
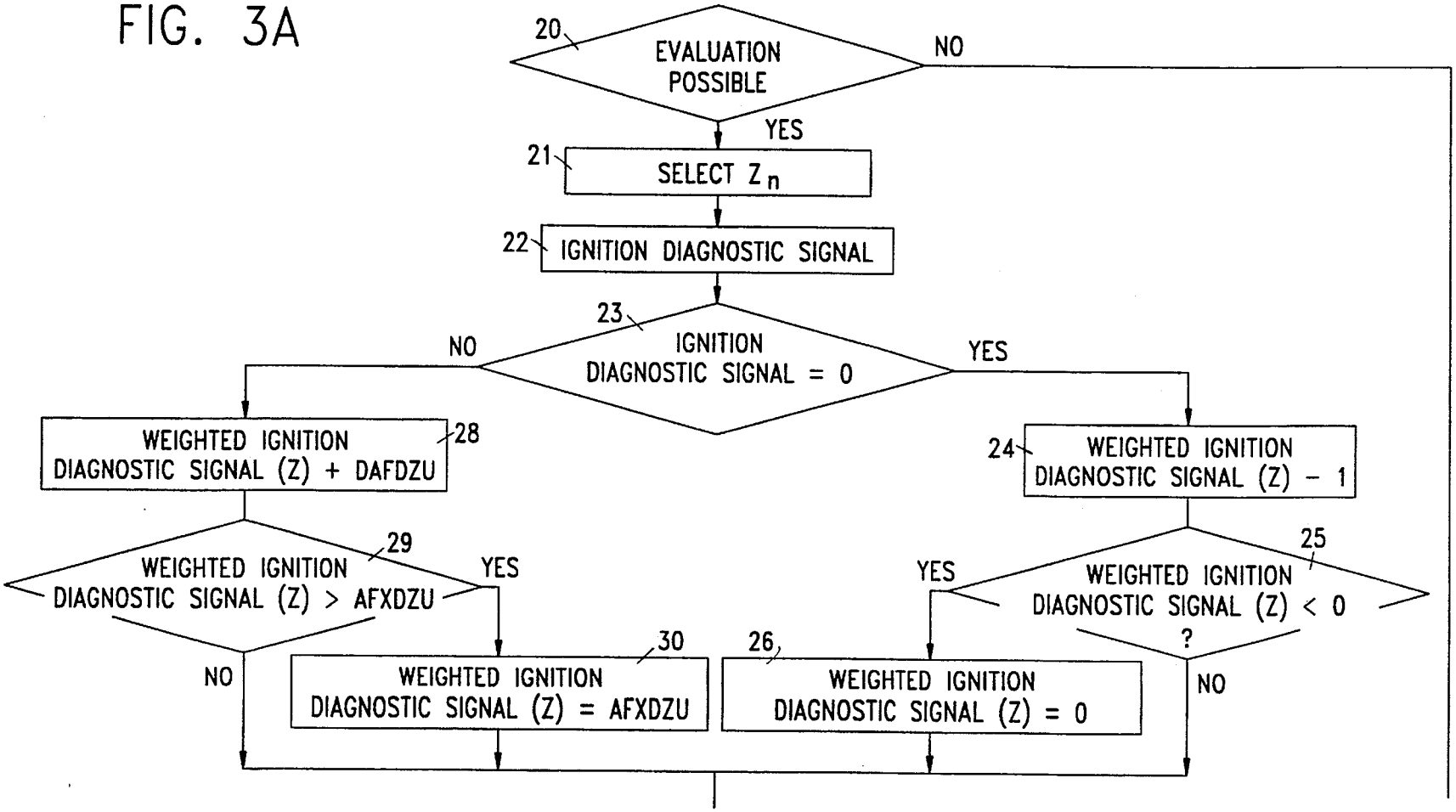
FIG. 3 shows the sequence of the program for weighting the ignition-diagnostic signal.
Figure 3B:
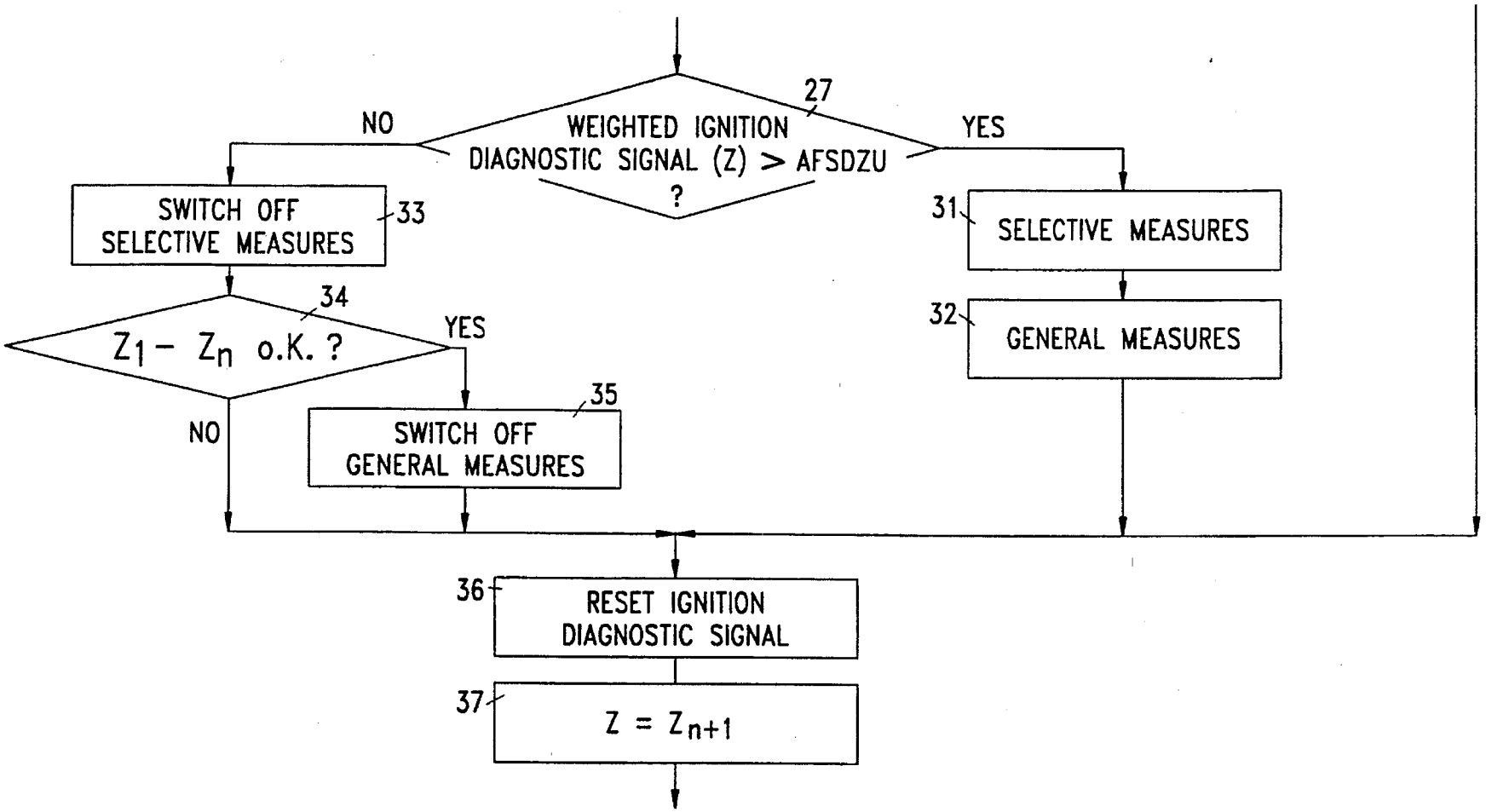

The sequence of the program in the microprocessor 1 for the statistical evaluation of the ignition-diagnostic signal (Zünd OK) is represented in FIG. 3 and will be explained below jointly with FIG. 4.

Figure 4:
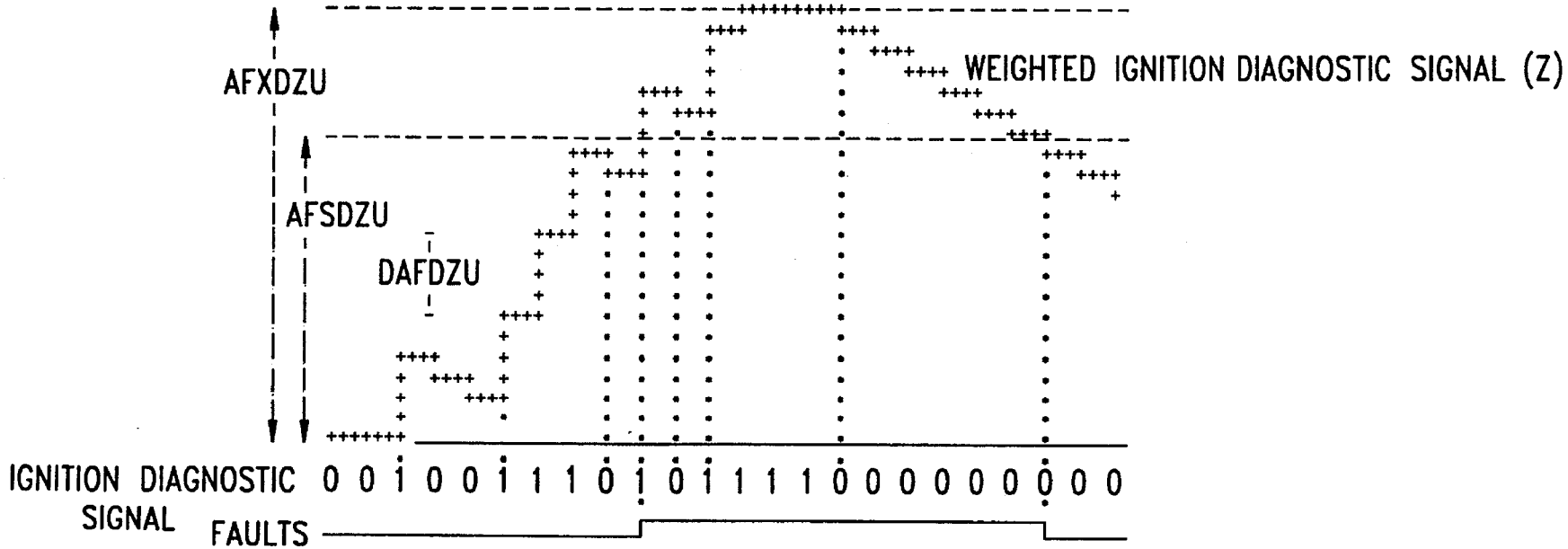
FIG. 4 shows a diagram of the weighted ignition-diagnostic value for one cylinder.

FIG. 4 shows the statistical weighting of the cylinder-selective ignition-diagnostic signals (Zünd OK) for a cylinder, as it takes place in the program represented in FIG. 3. At the beginning of the process in FIG. 3, an interrogation 20 checks whether an evaluation of the signals is possible. This will, for example, check whether the battery voltage $U_B$ has the necessary level, because $U_B$ is too small directly after starting and, therefore, no signals are detected. If this question is answered with yes, i.e. if an evaluation is possible, an operational step 21 selects the cylinder whose ignition-diagnostic signal (Zünd OK) is to be weighted. In the following operational step 22, the ignition-diagnostic signal (Zünd OK) of this cylinder (Z) is now used for evaluation after each point of ignition (Z). An interrogation 23 checks whether the ignition-diagnostic signal (Zünd OK) is equal to zero. If this is the case, i.e. if the ignition in the cylinder was in order, the value 1 is subtracted from the weighted ignition-diagnostic value (ZÜNTAB) in an operational step 24. An interrogation 25 then checks whether ZÜNTAB<0. If this is the case, the operational step 26 resets the weighted ignition-diagnostic value (ZÜNTAB) for this cylinder to zero. The negative output of the interrogation 25 and the operational step 26 lead to the interrogation 27. If the interrogation 23 was answered with no, i.e. if the ignition-diagnostic signal for this cylinder was not correct, then the weighted ignition-diagnostic value (ZÜNTAB) is increased by an amount (DAFDZU). This amount (DAFDZU) is determined in practice for each engine type. After this operational step 28, the interrogation 29 checks whether the weighted ignition-diagnostic value (ZÜNTAB) has exceeded a maximum permissible limiting value (AFXDZU). If this is the case, the operational step 30 limits the weighted ignition-diagnostic value to this maximum permissible value (AFXDZU). The negative output of the interrogation 29 and the operational step 30 likewise lead to the interrogation 27. The interrogation 27 now checks whether the weighted ignition-diagnostic value (ZÜNTAB) is greater than a threshold (AFSDZU) which, if exceeded, means that measures to protect the catalyst should be introduced. This threshold (AFSDZU) is determined in practice for each engine type and can likewise be varied as a function of operating conditions of the engine. The threshold (AFSDZU) selected will generally be greater than zero and smaller than or equal to the maximum permissible value. If this threshold (AFSDZU) of the weighted ignition-diagnostic value (ZÜNTAB) has been exceeded, cylinder-selective emergency measures, such as switching off the injection in this cylinder, are introduced in the operational step 31. Global measures for protecting the catalyst, such as switching off the lambda control, are subsequently undertaken in the operational step 32. The negative output of the interrogation 27 leads to the operational step 33, by means of which no cylinder-selective emergency measures are introduced or emergency measures previously activated in this cylinder are withdrawn. The subsequent interrogation 34 checks whether all cylinders ($Z_1$–$Z_n$) are operating correctly. If this is the case (positive output), the global emergency measures are also withdrawn in the operational step 35. If, however, one cylinder is still operating incorrectly, the global measures remain activated or are activated. The ignition-diagnostic signal is then reset in the operational step 36 and is stored, for example, in a memory device. An operational step 37 now increases the cylinder number by one and undertakes the weighting of the ignition-diagnostic signal for this cylinder. Storing the ignition-diagnostic signal in a memory device makes it possible, during a visit to a workshop, to check the function of the ignition system retroactively and to make any necessary repairs.

The ignition-diagnostic signal (Zünd OK) is shown in FIG. 4. It may be clearly recognized that in the case of each faulty ignition (Zünd OK=1), the weighted ignition-diagnostic value (ZÜNTAB) is increased by the amount (DAFDZU), 4 in the case of the example, and is decremented by 1 in the case of a correct ignition. The limitation of the weighted ignition-diagnostic value (ZÜNTAB) to a permissible maximum value (AFXDZU) and to the minimum value 0 may likewise be recognized. It is likewise very easy to recognize from this diagram that a fault is recognized in this cylinder during the time when the permissible threshold (AFSDZU) is being exceeded so that corresponding cylinder-selective and global emergency measures are introduced and a fault display for the driver takes place simultaneously.

The interval between the maximum value (AFXDZU) and the permissible threshold (AFSDZU) determines the number of correct ignitions, which must occur one after the other at the cylinder affected until the correction of the ignition defect is recognized.

What is claimed is:

1. An ignition system for an internal combustion engine, comprising:

a monitoring circuit for generating an ignition diagnostic signal, the ignition diagnostic signal indicating one of a correct ignition and an incorrect ignition;

a sensor circuit coupled to the monitoring circuit for monitoring the occurrence of an ignition; and a control unit, coupled to the monitoring circuit, the control unit controlling the monitoring circuit to set the ignition diagnostic signal to a first predetermined level prior to each scheduled ignition and controlling the monitoring circuit to set the ignition diagnostic signal to a second predetermined level after each correct ignition, the control unit also monitoring the level of the ignition diagnostic signal, the control unit performing a statistical weighting, for each cylinder of the internal combustion engine, of a current ignition diagnostic signal and each preceding ignition diagnostic signal to obtain a current ignition diagnostic value, the control unit triggering at least one emergency measure for protecting a catalyst when the current ignition diagnostic value exceeds a predetermined fault threshold, wherein the control unit increases the current ignition diagnostic value by a first predetermined amount in response to each incorrect ignition and decrements the current ignition diagnostic value by a second predetermined amount in response to each correct ignition.

2. The ignition system according to claim 1, wherein the second predetermined amount is 1 and the first predetermined amount is greater than 1.

3. The ignition system according to claim 1, wherein the predetermined fault threshold is adjusted for different engine types to values >1.

4. The ignition system according to claim 1, wherein the current ignition diagnostic value is limited to a maximum value.

5. The ignition system according to claim 4, wherein a difference between the maximum value and the predetermined fault threshold establishes a number of correct ignitions subsequent to an incorrect ignition which must occur before correction of a fault is recognized.

6. The ignition system according to claim 5, wherein the at least one emergency measure is discontinued when the current ignition-diagnostic value falls below the predetermined fault threshold.

7. The ignition system according to claim 1, wherein a fault indication is stored in the vehicle when the predetermined fault threshold is exceeded.

8. The ignition system according to claim 7, wherein a fault indication is displayed to a vehicle occupant when the predetermined fault threshold is exceeded.

9. The ignition system according to claim 1, wherein an injection for a corresponding cylinder is interrupted and a lambda control is switched off when the predetermined fault threshold is exceeded.

10. An ignition system for an internal combustion engine, comprising:

a sensor circuit for monitoring the occurrence of an ignition;

a monitoring circuit coupled to the sensor circuit for generating an ignition diagnostic signal, the ignition diagnostic signal indicating one of a correct ignition and an incorrect ignition, the monitoring circuit setting the ignition diagnostic signal to a first predetermined level prior to each scheduled ignition and setting the ignition diagnostic signal to a second predetermined level after each correct ignition; and a control unit coupled to the monitoring circuit, the control unit monitoring the level of the ignition diagnostic signal, the control unit performing a statistical weighting, for each cylinder of the internal combustion engine, of a current ignition diagnostic signal and each preceding ignition diagnostic signal to obtain a current ignition diagnostic value, the control unit triggering at least one emergency measure for protecting a catalyst when the current ignition diagnostic value exceeds a predetermined fault threshold, wherein the control unit increases the current ignition diagnostic value by a first predetermined amount in response to each incorrect ignition and decrements the current ignition diagnostic value by a second predetermined amount in response to each correct ignition.

11. The ignition system according to claim 10, wherein the second predetermined amount is 1 and the first predetermined amount is greater than 1.

12. The ignition system according to claim 10, wherein the predetermined fault threshold is adjusted for different engine types to values >1.

13. The ignition system according to claim 10, wherein the current ignition diagnostic value is limited to a maximum value.

14. The ignition system according to claim 10, wherein a difference between the maximum value and the predetermined fault threshold establishes a number of correct ignitions subsequent to an incorrect ignition which must occur before correction of a fault is recognized.

15. The ignition system according to claim 14, wherein the at least one emergency measure is discontinued when the current ignition-diagnostic value falls below the predetermined fault threshold.

16. The ignition system according to claim 10, wherein a fault indication is stored in the vehicle when the predetermined fault threshold is exceeded.

17. The ignition system according to claim 16, wherein a fault indication is displayed to a vehicle occupant when the predetermined fault threshold is exceeded.

18. The ignition system according to claim 10, wherein an injection for a corresponding cylinder is interrupted and a lambda control is switched off when the predetermined fault threshold is exceeded.

* * * * *